US005175945A

United States Patent [19]

Skaugen et al.

[11] Patent Number: 5,175,945

[45] Date of Patent: * Jan. 5, 1993

[54] APPARATUS FOR DRYING A WEB

[75] Inventors: Borgeir Skaugen; Gregory L. Wedel, both of Beloit, Wis.

[73] Assignee: Beloit Corporation, Beloit, Wis.

[ * ] Notice: The portion of the term of this patent subsequent to Jun. 19, 2007 has been disclaimed.

[21] Appl. No.: 429,730

[22] Filed: Oct. 26, 1989

Related U.S. Application Data

[63] Continuation of Ser. No. 14,569, Feb. 13, 1987, Pat. No. 4,934,067.

[51] Int. Cl.[5] ..... F26B 13/16

[52] U.S. Cl. ..... 34/117; 34/116

[58] Field of Search ..... 34/111, 113, 114, 115, 34/116, 117, 120, 123

[56] References Cited

U.S. PATENT DOCUMENTS

| | | | |
|---|---|---|---|
| 2,537,129 | 1/1951 | Goodwillie . | |
| 2,714,342 | 8/1955 | Beachler . | |
| 2,959,222 | 11/1960 | Hornbostel . | |
| 3,110,612 | 11/1963 | Gottwald et al. . | |
| 3,263,344 | 8/1966 | Stickle . | |
| 3,868,780 | 3/1975 | Soininen et al. . | |
| 4,000,035 | 12/1976 | Schiel et al. . | |
| 4,202,113 | 5/1980 | Kankaanpaa . | |
| 4,359,827 | 11/1982 | Thomas . | |
| 4,441,263 | 4/1984 | Vedenpää . | |
| 4,481,723 | 11/1984 | Vedenpää . | |
| 4,483,083 | 11/1984 | Chance . | |
| 4,510,698 | 4/1985 | Ely . | |
| 4,539,762 | 9/1985 | Eskelinen et al. . | |
| 4,566,944 | 1/1986 | Mauranen et al. . | |
| 4,608,124 | 8/1986 | Mauranen et al. . | |
| 4,625,430 | 12/1986 | Aula et al. . | |
| 4,677,762 | 7/1987 | Futchen | 34/114 |
| 4,686,778 | 8/1987 | Kotitschke et al. . | |
| 4,934,067 | 6/1990 | Wedel | 34/117 |

FOREIGN PATENT DOCUMENTS

| | | |
|---|---|---|
| 2355397 | 6/1974 | Fed. Rep. of Germany . |
| 2813933 | 10/1978 | Fed. Rep. of Germany . |
| 3520070 | 12/1985 | Fed. Rep. of Germany . |
| 8202937 | 9/1982 | PCT Int'l Appl. . |
| 2173832 | 10/1986 | United Kingdom . |

OTHER PUBLICATIONS

G. L. Wedel and S. Palazzolo, "Advances in dryer section runnability", *Tappi Journal*, Sep. 1987, pp. 65–69.

Beloit Corporation Engineering Drawing No. AD-41-0-4-6-4 Feb. 21, 1990.

*Primary Examiner*—Henry A. Bennet

*Attorney, Agent, or Firm*—Dirk J. Veneman; Raymond W. Campbell; David J. Archer

[57] ABSTRACT

An apparatus is disclosed for drying a web of paper emerging from a press section of a papermaking machine. The apparatus incudes a first dryer section means for initiating the drying of the first side of the web. A first transfer arrangement transfers the web from the press section to the first dryer section. A second dryer section is disposed downstream relative to the first dryer section for initiating the drying of a second side of the web, the second side of the web being opposite to the first side thereof. A first dryer transfer arrangement transfer the web without open draw between the first and second dryer sections. The first dryer transfer arrangement permits both threading of the web without the assistance of threading ropes and the drying of both sides of the web.

8 Claims, 6 Drawing Sheets

APPARATUS FOR DRYING A WEB

This application is a continuation of Ser. No. 07/014,569 filed Feb. 13, 1987 now U.S. Pat. No. 4,934,067.

BACKGROUND OF THE INVENTION

1. Field of the Invention

This invention relates to an apparatus for drying a web of paper emerging from a press section of a papermaking machine. More particularly, this invention relates to an apparatus for drying a web in which the web is transferred without open draw between dryer sections, thereby permitting threading of the web without the assistance of threading ropes and the drying of both sides of the web.

2. Information Disclosure Statement

With the ever increasing operational speed of papermaking machines a serious problem has existed in that there is a tendency for the paper web or sheet to flutter as the sheet progresses through the dryer section. Such sheet flutter is particularly evident when the sheet is transferred between succeeding sections of the dryer section as the web is transferred between these adjacent sections in an open draw. Such sheet flutter has been minimized by the use of single felting configurations in which the web and felt run jointly between respective top and bottom cylinders. However, the single felt configuration, although reducing the aforementioned problem of sheet flutter, introduces several disadvantages. Included amongst these disadvantages are, first, the heat transfer from the bottom cylinders is substantially reduced because the wet web is no longer in direct contact with the cylinders, the felt being interposed between the web and the drying surface of the respective cylinder. Second, the web has a tendency to separate from the felt as the web travels towards and around and then away from the bottom cylinder. Third, the initial threading of the web is not particularly easy.

A partial solution to the aforementioned single felt problems has been provided by the application of the so-called Bel Run dryer section. Bel Run is a registered trademark of Beloit Corporation. With the Bel Run system, the bottom ineffective dryers are replaced by vacuum rolls which positively convey the web from one cylinder to the next. Recent installations of this type of dryer section have shown that the Bel Run concept can be extended to include a large number of dryers without any adverse effect on the web runability. Such runability results because the vacuum rolls are capable of conveying the web along the felt supported spans without the need for sheet tension or section draw points.

With the implementation of the single Bel Run section there exists a tendency to have a generation of stresses which develop in the web as the web dries. Such stresses impart a tendency for the dried paper to curl. Such adverse curling effect can be minimized or eliminated by drying the web from both sides, but two sided drying requires a transfer point in which the web is transferred from one felt to another felt. In the case of the Bel Run configuration, the web must be alternately dried on a top tier dryer section and then on a bottom tier dryer section. A top tier section may be defined as a group of dryers in which the bottom surface of the web contacts the dryers. A bottom tier section conversely and correspondingly may be defined as a group of dryers in which the top surface of the web contacts the dryers.

In order to efficiently transfer the web from one Bel Run section to another, a positive transfer arrangement is required. In the prior art such means for transferring the web from one drying section to the next has required the introduction of an open draw with the associated problems of sheet flutter and the like.

Modern paper drying machines are contemplated in which web speeds of 10,000 or more feet per minute are invisaged. Consequently, the introduction of such open draws would lead to serious problems of sheet flutter and numerous web breakages. The present invention seeks to overcome the aforementioned inadequacies of the prior art apparatus and to provide a drying apparatus which contributes a significant and non-obvious contribution to the paper drying art.

Another object of the present invention is the provision of an apparatus for drying a web of paper emerging from a press section of a papermaking machine such that the web is transferred between a first and a second dryer section means without open draw, thereby permitting both threading of the web without the assistance of threading ropes and the drying of the web on both sides thereof. Another object of the present invention is the provision of an apparatus for drying a web of paper which completely eliminates the need of open draws.

Another object of the present invention is the provision of an apparatus for drying a web of paper in which open draws for the sheet or web is eliminated.

Another object of the present invention is the provision of an apparatus for drying a web of paper in which blow boxes would be redundant.

Another object of the present invention is the provision of an apparatus for drying a web of paper in which ventilation of the pockets defined by the cylinders and the vacuum rolls is improved, thereby improving the drying rate of the web.

Another object of the present invention is the provision of an apparatus for drying a web of paper in which gear case leaks are inhibited and removal of broke is facilitated.

Another object of the present invention is the provision of an apparatus for drying a web of paper in which fewer steamfits are required and none of the dryers are redundant, thereby reducing the blow through rate.

Another object of the present invention is the provision of an apparatus for drying a web of paper in which the frame is symmetrical and in which the base frame is subjected to equal loading forces, thereby resulting in sturdy low-profile frame which reduces vibration and its attendant noise level.

Another object of the present invention is the provision of an apparatus for drying a web of paper in which the power required to drive the cylinders is reduced and due to the layout and configuration of the dryers, such arrangement lends itself to the provision of a low-profile hood.

Another object of the present invention is the provision of an apparatus for drying a web of paper in which runability of the drying apparatus is increased and in which doctors can be applied to each dryer.

Another object of the present invention is the provision of an apparatus for drying a web of paper which permits automatic threading of a tail and subsequent web therethrough.

Another object of the present invention is the provision of an apparatus for drying a web in which open access to the dryers and vacuum rolls is provided and a supply of air can be fed uniformly through each of the vacuum rolls.

Another object of the present invention is the provision of an apparatus for drying a web of paper in which hoods are provided over and adjacent the vacuum rolls for handling the humid exhaust and possibly eliminating the need for large scale exhaust hood construction.

Another object of the present invention is the provision of an apparatus for drying a web of paper in which such vacuum roll hoods can be provided for profiling the web by removing exhaust air from selected transfer sections of these hoods.

Other objects and advantages of the present invention will be apparent to those skilled in the art by a consideration of the following detailed description taken in conjunction with the annexed drawings.

Although, the detailed description and annexed drawings describe a preferred embodiment of the present invention, it should be appreciated by those skilled in the art that many variations and modifications of the present invention fall within the spirit and scope of the present invention as defined by the appended claims.

SUMMARY OF THE INVENTION

The present invention relates to an apparatus and method for drying a web of paper emerging from the press section of a papermaking machine. The apparatus includes a first dryer section means for initiating the drying of the first side of the web. The first transfer means transfers the web from the press section to the first dryer section means. A second dryer section means is disposed downstream relative to the first dryer section means for initiating the drying of the second side of the web. The second side of the web is opposite to the first side of the web. A first dryer transfer means transfers the web without open draw between the first and the second dryer section means such that the first dryer transfer means permits both threading of the web without the assistance of threading ropes and the drying of both sides of the web.

More particularly, the first dryer section means also includes a first dryer section for initiating the drying of the first side of the web and a second section disposed downstream relative to the first dryer section for continuing the drying of the first side of the web. A second dryer transfer means transfers the web without open draw between the first and the second dryer sections.

The first dryer section includes a first plurality of dryers and a first plurality of vacuum rolls with each of the vacuum rolls being disposed adjacent to a corresponding dryer of the first plurality of dryers such that the web extends alternately past each vacuum roll and a dryer in serpentine configuration. The first felt extends around the first plurality of dryers and the first plurality of vacuum rolls in close conformity with the web. The second dryer includes a second plurality of dryers and a second plurality of vacuum rolls with each vacuum roll of the second plurality of vacuum rolls being disposed adjacent to a corresponding dryer of the second plurality of dryers, such that the web extends alternately past each vacuum roll and dryer in serpentine configuration. A second felt extends around the second plurality of dryers and vacuum rolls respectively such that the second felt is disposed in close conformity with the web. The second felt and an unfelted portion of a downstream dryer of the first dryers defines a first pick-up section for transferring the web from the unfelted portion onto the second felt so that the web is transferred without draw from the first dryer section to the second dryer section.

Each of the vacuum rolls of the first and the second dryer sections are disposed in spaced close proximity to their adjacent corresponding dryers such that the felt draw between each of the vacuum rolls and the corresponding dryer is minimal, thereby inhibiting any tendency of the web to flutter relative to the supporting felts.

The apparatus also includes a base frame for rotatably supporting the first and the second plurality of dryers such that the axis of the first and the second plurality of dryers are disposed in the first plane. The frame also rotatably supports the first and the second plurality of vacuum rolls such that the axis of the first and second plurality of vacuum rolls disposed in a second plane with the first plane being disposed by the second plane.

An upstream vacuum roll of the second plurality of vacuum rolls is disposed in close proximity to the unfelted portion of the downstream dryer of the first dryer section. A first felt roll is rotatably supported by the base frame for guiding the second felt past and in conformity with the unfelted portion of the downstream dryer and thereafter around the upstream vacuum roll of the second dryer section such that the web is transferred from the unfelted portion to the second felt without open draw.

The first transfer means for transferring the web from the press section to the first dryer section means also includes a lead in roll which is disposed in spaced close proximity relative to the press section. The first felt extends around the lead in roll for transferring the web from the press section to the first dryer section means. A guide roll is disposed between the lead in roll and the first dryer section means for assisting the transfer of the web from the press section towards the first dryer section means. A transfer felt extends around the guide roll such that the transfer felt and the first felt defined therebetween a transfer section for transferring the web from the press section towards the first dryer section means.

The first transfer means also includes an upstream vacuum roll of the first dryer section means. This upstream vacuum roll cooperates with the first felt and the transfer felt such that the transfer section extends from the guide roll to the upstream vacuum roll so that the web emerging from the transfer section is guided around the upstream vacuum roll into the first dryer section means.

The second dryer section means also includes a third plurality of dryers with each of the dryers of this third plurality of dryers being disposed downstream relative to the first dryer section means. A third plurality of vacuum rolls are each disposed in spaced close proximity relative to a corresponding dryer of the third plurality of dryers such that the web extends alternately past each vacuum roll and dryer of the second dryer section means in serpentine configuration.

The third plurality of dryers and vacuum rolls are rotatably secured to the base frame such that the third plurality of dryers are disposed in a third plane and the third plurality of vacuum rolls disposed in a fourth plane with the fourth plane being disposed above the third plane. A third felt extends past the third plurality of dryers and vacuum rolls such that the third felt supports the web through the second dryer section means with the second side of the web being urged by the third felt into close conformity with each dryer of the third plurality of dryers.

The first dryer transfer means also includes a downstream vacuum roll of the first dryer section means. A downstream felt roll of the first dryer section means, a second felt of the first dryer section means extends between the downstream vacuum roll and the downstream felt roll with the second felt supporting the web such that the web is conveyed and disposed between the second felt and the second dryer section means.

The first dryer transfer means also includes an upstream vacuum roll of the second dryer section means and an upstream felt roll. A third felt extends between the upstream felt roll and the upstream vacuum roll of the second dryer section means such that the third felt and the second felt define therebetween a first dryer transfer means section for transferring the web without open draw from the second to the third felt.

Subsequent dryer section means are provided such that the first, second, third and fourth dryer transfer means permit the transfer of the web between their respective dryer sections without open draw with an alternate reversing of the web such that the first and second side of the web are alternately dried as the web extends through the apparatus and past succeeding dryer section means.

The invention also includes a method of drying a web of paper emerging from a press section of a papermaking machine, the method comprising the steps of transferring the web from the press section to a first dryer section of the apparatus, initiating the drying of a first side of the web during passage of the web through the first dryer and transferring the web without open draw between the first dryer section and a downstream second dryer section, the web transfer being such that the web is reversed so that drying of a second side of the web is initiated during passage of the web through the second dryer section, the second side of the web being opposite to the first side of the web.

The method also includes the step of transferring the web without open draw between subsequent dryer sections such that the first and second side of the web are alternately exposed to the drying effect of the subsequent dryer sections in sequence.

Although the following detailed description exemplifies a particular embodiment of the present invention, it should be understood by those skilled in the art that the present invention is not limited to such an arrangement. Rather the present invention as defined by the appending claims invisages a multitude of variations thereof, including a single felt extending around the dryers of the first and second dryer sections rather than using a first and second felt as shown in the drawings. Furthermore, although the present invention shows the drying apparatus with a first, second, third, fourth and fifth dryer section means, the present invention is not limited to such an arrangement and the various dryer section means may be staggered and disposed in any configuration thereof in order to reduce the overall length of the drying section without the introduction of an open draw.

DETAILED DESCRIPTIONS OF THE PREFERRED EMBODIMENT

Figure 1:
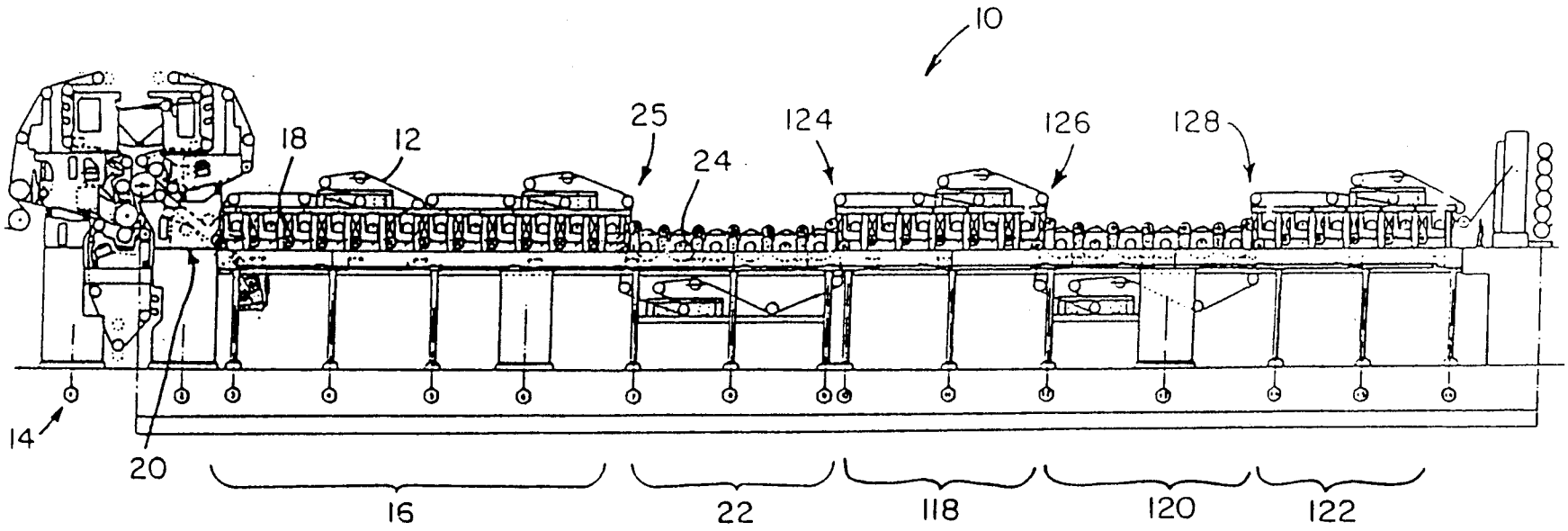
FIG. 1 is a side elevational view of the apparatus according to the present invention showing the press section the first transfer means, the first dryer section means, the second dryer section means, and the first dryer transfer means, according to the present invention.

FIG. 1 is a side elevational view showing the apparatus generally designated 10 for drying a web 12 of paper emerging from a press section, generally designated 14 of a paper making machine. The apparatus 10 includes a first dryer section means, generally designated 16 for initiating the drying of a first side 18 of the web 12.

A first transfer means generally designated 20 transfers the web 12 from the press section 14 to the first dryer section means 16.

A second dryer section means generally designated 22 is disposed downstream relative to the first dryer section means 16. This second dryer section means 22 initiates the drying of a second side 24 of the web 12. The second side 24 of the web 12 being opposite to the first side 18 thereof.

A first dryer transfer means generally designated 25 transfers the web 12 without open draw between the first and second dryer section means 16 and 22 respectively. The first dryer transfer means 25 permits both threading of the web 12 without the assistance of threading ropes and the drying of both sides 18 and 24 of the web 12.

Figure 2:
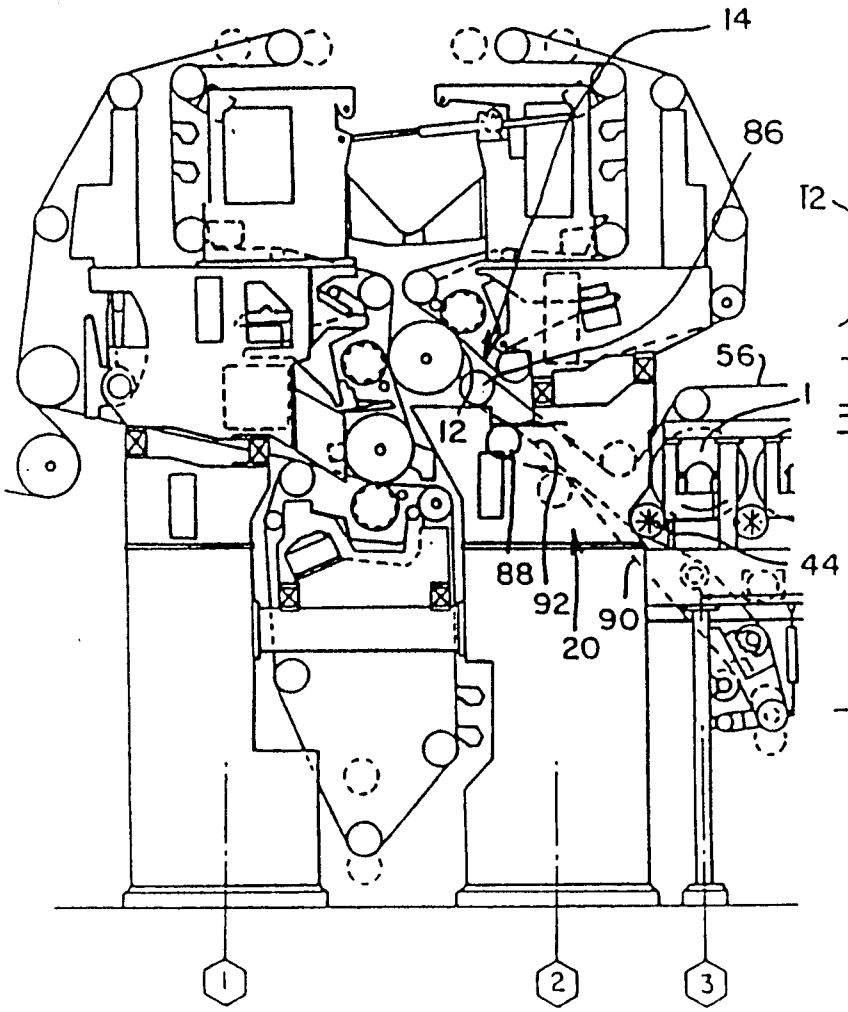
FIG. 2 is an enlarged fragmentary view of FIG. 1 showing the press section, and more particularly, the first transfer means for transferring the web from the press section to the first dryer section.

FIG. 2 shows in more detail the first transfer means 20 and will be described in more detail hereinafter.

Figure 3:
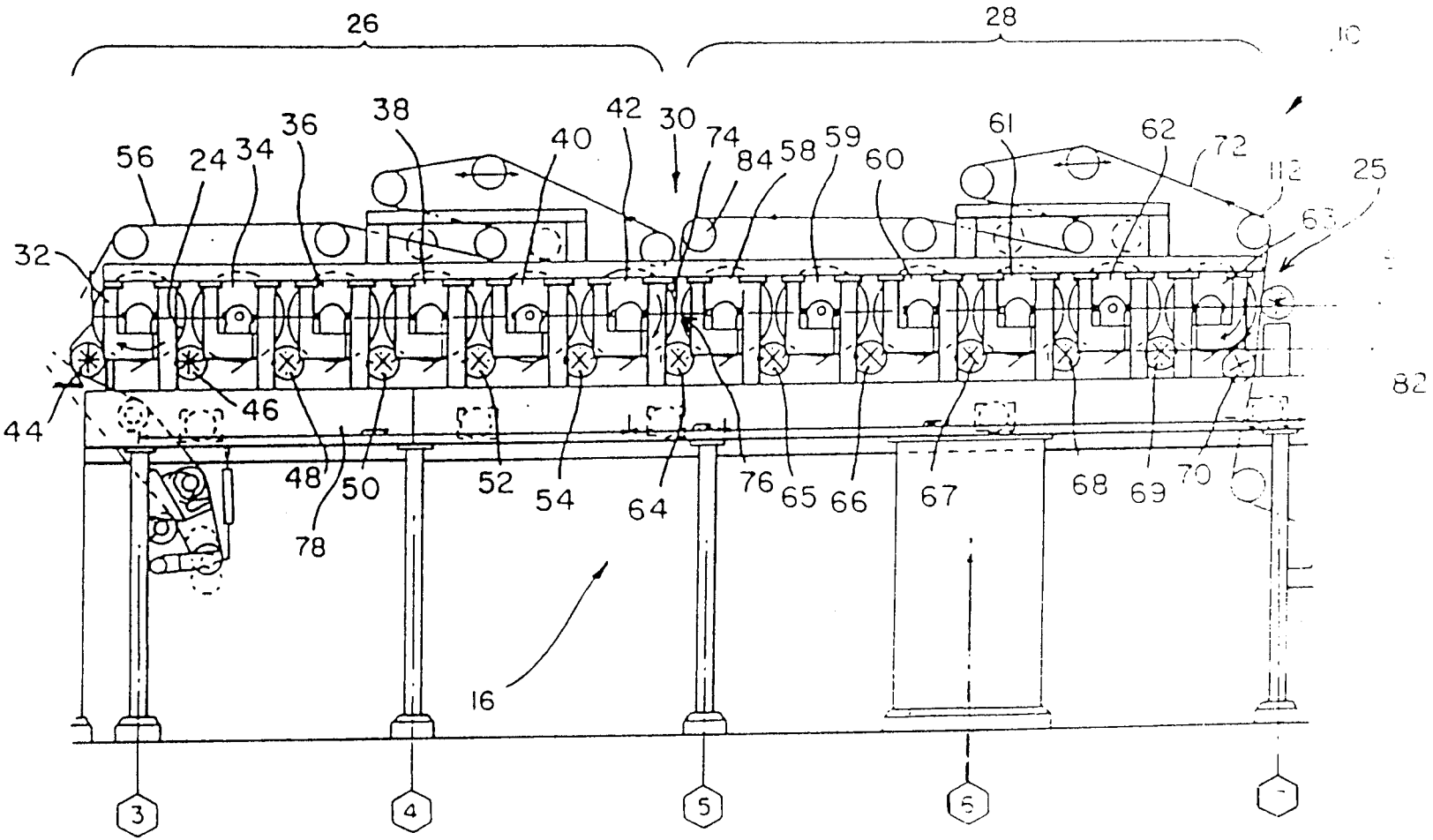
FIG. 3 is an enlarged fragmentary view of FIG. 1 showing the first dryer section means, including the first dryer section and the second dryer section.

FIG. 3 shows in detail the first dryer section means 16. This first dryer section means 16 includes a first dryer section generally designated 26 for initiating the drying of the first side 18 of the web 12. A second dryer section generally designated 28 is disposed downstream realtive to the first dryer section 26 for continuing the drying of the first side 18 of the web 12. A second dryer transfer means generally designated 30 transfers the web 12 without open draw between the first and the second dryer sections 26 and 28 respectively.

More particularly, with reference to FIG. 3, the first dryer section also includes a first plurality of dryers 32, 34, 36, 38, 40 and 42 respectively. The first dryer section 26 also includes a first plurality of vacuum rolls 44, 46, 48, 50, 52 and 54 respectively. The first plurality of vacuum rolls 44 to 54 are disposed adjacent to a corresponding dryer of the first plurality of dryers 32 to 42 such that the web 12 extends alternately past each vacuum roll 44 to 54 and dryer 32 to 42 in serpentine configuration.

A first felt 56 extends around the first plurality of dryers 32 to 42 and the first plurality of vacuum rolls 44 to 54 in close conformity with the web 12.

The second dryer section 28 also includes a second plurality of dryers 58, 59, 60, 61, 62 and 63.

The second dryer section 28 also includes a second plurality of vacuum rolls 64, 65, 66, 67, 68, 69 and 70. The vacuum rolls 64 to 70 are disposed adjacent to a corresponding dryer of the second plurality of dryers 58 to 63 such that the web 12 extends alternately past each vacuum roll 64 to 70 and dryer 58 to 63 in serpentine configuration.

A second felt 72 extends around the second plurality of dryers 58 to 63 and the vacuum rolls 64 to 70 respectively such that the second felt 72 is disposed in close conformity with the web 12.

The second felt 72 and an unfelted portion 74 of the downstream dryer 42 of said first dryers 32 to 42 defines a first pick-up section generally designated 76 for transferring the web 12 from the unfelted portion 74 onto the second felt 72 so that the web 12 is transferred without draw from the first dryer section 26 to the second dryer section 28.

Each of the vacuum rolls of the first and the second dryer sections 26 to 28 are disposed in spaced close proximity to their adjacent corresponding dryers such that the felt draw between each of the vacuum rolls and their corresponding dryers is minimal, thereby inhibiting any tendency of the web to flutter relative to the supporting felts 56 and 72 respectively.

As shown in FIG. 3 the apparatus 10 also includes a base frame 78 for rotatably supporting both the first and the second plurality of dryers such that the axis of the first and second plurality of dryers are disposed in a first plane 80 as shown in FIG. 3.

Additionally, the frame 78 rotatably supports the first and second plurality of vacuum rolls such that the axis of the first and the second plurality of vacuum rolls are disposed in a second plane 82 shown in FIG. 3. The first plane 80 is disposed above the second plane 82 as shown in FIG. 3.

As shown in FIG. 3 the apparatus 10 includes an upstream vacuum roll 64 of the second plurality of vacuum rolls and this vacuum roll 64 is disposed in spaced close proximity to the unfelted portion 74 of the downstream dryer 42 of the first dryer section 26.

A first felt roll 84 is rotatably supported by the base frame 78 for guiding the second felt 72 past and in conformity with the unfelted portion 74 of the downstream dryer 42 and thereafter around the upstream vacuum roll 64 of the second dryer section 28 such that the web 12 is transferred from the unfelted portion 74 to the second felt 72 without open draw.

As shown in FIG. 2 referred to hereinbefore the apparatus 10 includes a first transfer means 20 for transferring the web 12 from the press section 14 to the first dryer section means 16. This first transfer means 20 further includes a lead in roll 86 which is disposed in spaced close proximity relative to the press section 14. The first felt 56 extends around this lead in roll 86 for transferring the web 12 from the press section 14 to the first dryer section means 16.

A guide roll 88 is disposed between the lead in roll 86 and the first dryer section means 16 for assisting the transfer of the web 12 from the press section 14 towards the first dryer section means 16.

A transfer felt 90 extends around the guide roll 88 such that the transfer felt 90 and the first felt 56 define therebetween a transfer section 92 for transferring the web 12 from the press section 14 toward the first dryer section means 16.

With further reference to FIG. 2, the first transfer means 20 further includes an upstream vacuum roll 44 of said first dryer section means 16. The upstream vacuum roll 44 cooperates with the first felt 56 and the transfer felt 90 such that the transfer section 92 extends from the guide roll 88 to the upstream vacuum roll 44 so that the web 12 emerging from the transfer section 92 is guided around the upstream vacuum roll 44 into the first dryer section means 16.

Figure 4:
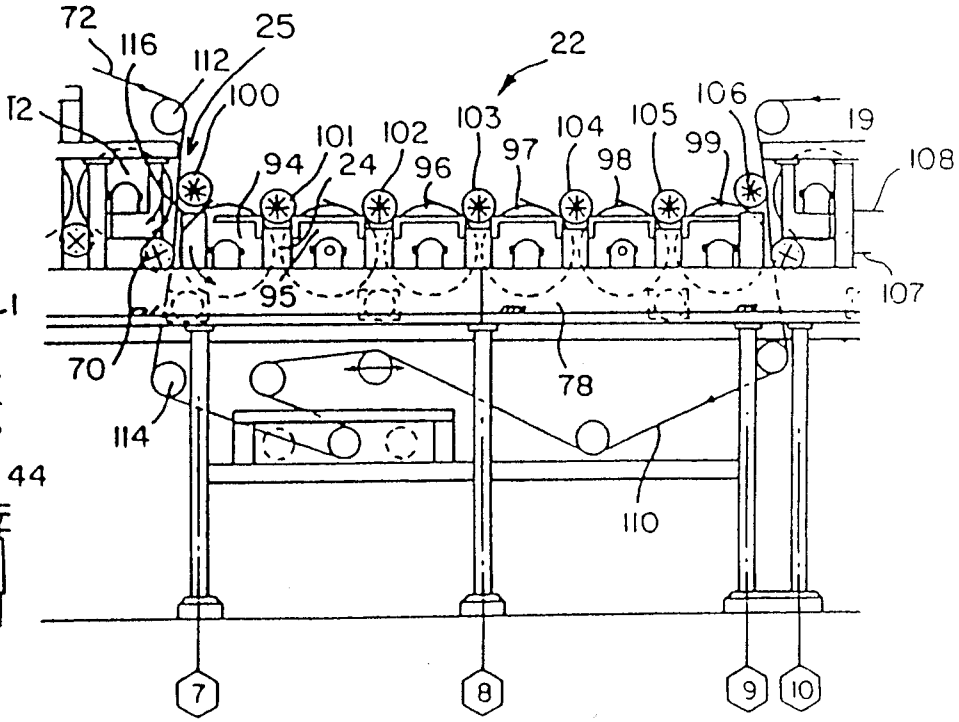
FIG. 4 is an enlarged fragmentary view of FIG. 1 showing the second dryer section means.

With reference to FIG. 4 the second dryer section means 22 also includes a third plurality of dryers 94, 95, 96, 97, 98 and 99. The third plurality of dryers being disposed downstream relative to the first dryer section means 16.

A third plurality of vacuum rolls 100, 101, 102, 103, 104, 105 and 106 are disposed in spaced close proximity relative to a corresponding dryer of the third plurality of dryers such that the web 12 extends alternately past each vacuum roll and dryer of the second dryer section means 22 in serpentine configuration.

As shown in FIG. 4 the base frame 78 rotatably supports each of the dryers of the third plurality of dryers such that the axis of the dryers are disposed in the third plane 107.

The base frame 78 also rotatably supports each of the vacuum rolls such that the axis of each of the vacuum rolls of the third plurality of vacuum rolls are disposed in a fourth plane 108 with the fourth plane being disposed above the third plane.

A third felt 110 extends past the third plurality of dryers and vacuum rolls such that the third felt supports the web through the second dryer section means 22 with the second side of the web being urged by the third felt 110 into close conformity with each dryer of the third plurality of dryers.

As shown in FIG. 4 the first dryer transfer means includes a downstream vacuum roll 70 of the first dryer section means 16 and a downstream felt roll 112 of the first dryer section 16.

The second felt 72 of the first dryer section means 16 extends between the downstream vacuum roll 70 and the downstream felt roll 112. The second felt 72 supports the web 12 that the web is conveyed and disposed between the second felt 72 and the second dryer section means 22.

The first dryer transfer means also includes an upstream vacuum roll 100 and upstream felt roll 114. A third felt 110 extends between the upstream felt roll 114 and the upstream vacuum roll 100 of the second dryer section means 22 such that the third felt 110 and the second felt 72 define therebetween a first dryer transfer means section 116 for transferring the web without open draw from the second to the third felts 72 and 110 respectively.

The third felt 110 presses against the web such that the second side of the web is pressed into close conformity with each dryer of the third plurality of dryers such that the second side of the web is dried.

Figure 6:
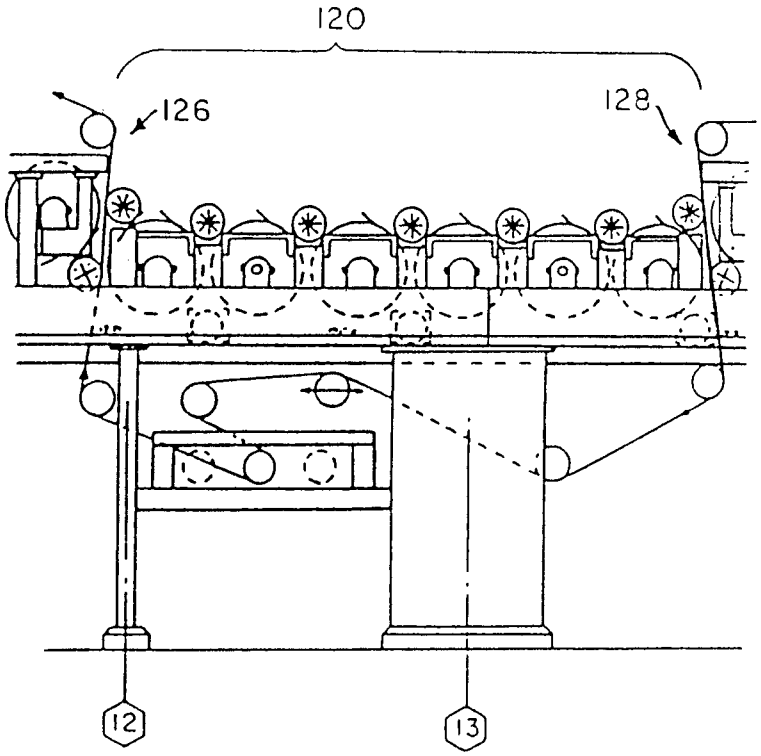
FIG. 6 is an enlarged fragmentary view of FIG. 1 showing the fourth dryer section means.
Figure 5:
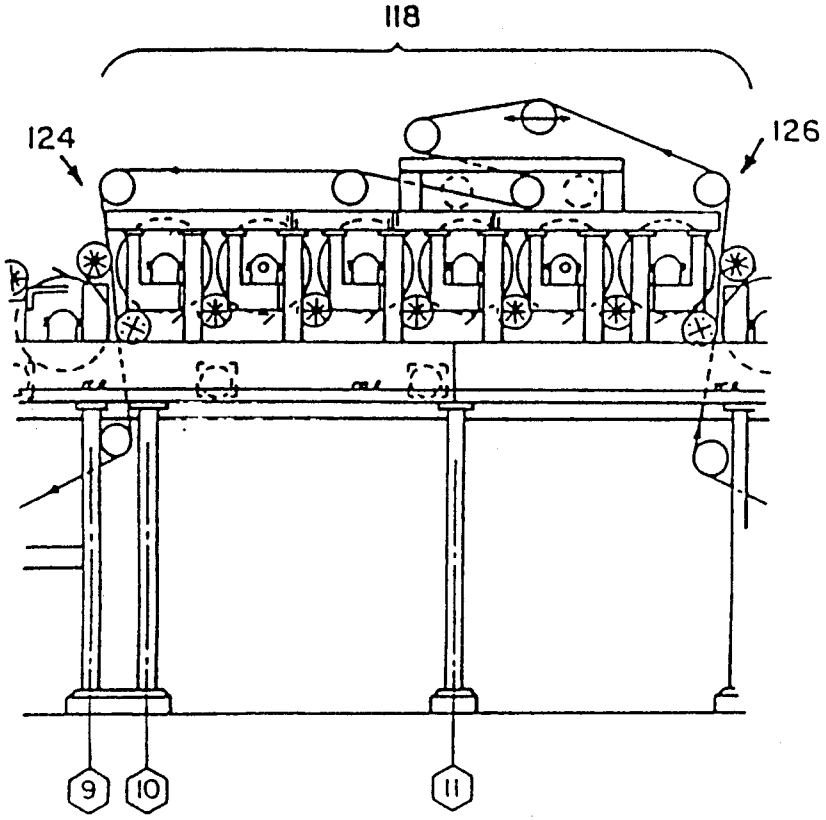
FIG. 5 is an enlarged fragmentary view of the third dryer section means.
Figure 7:
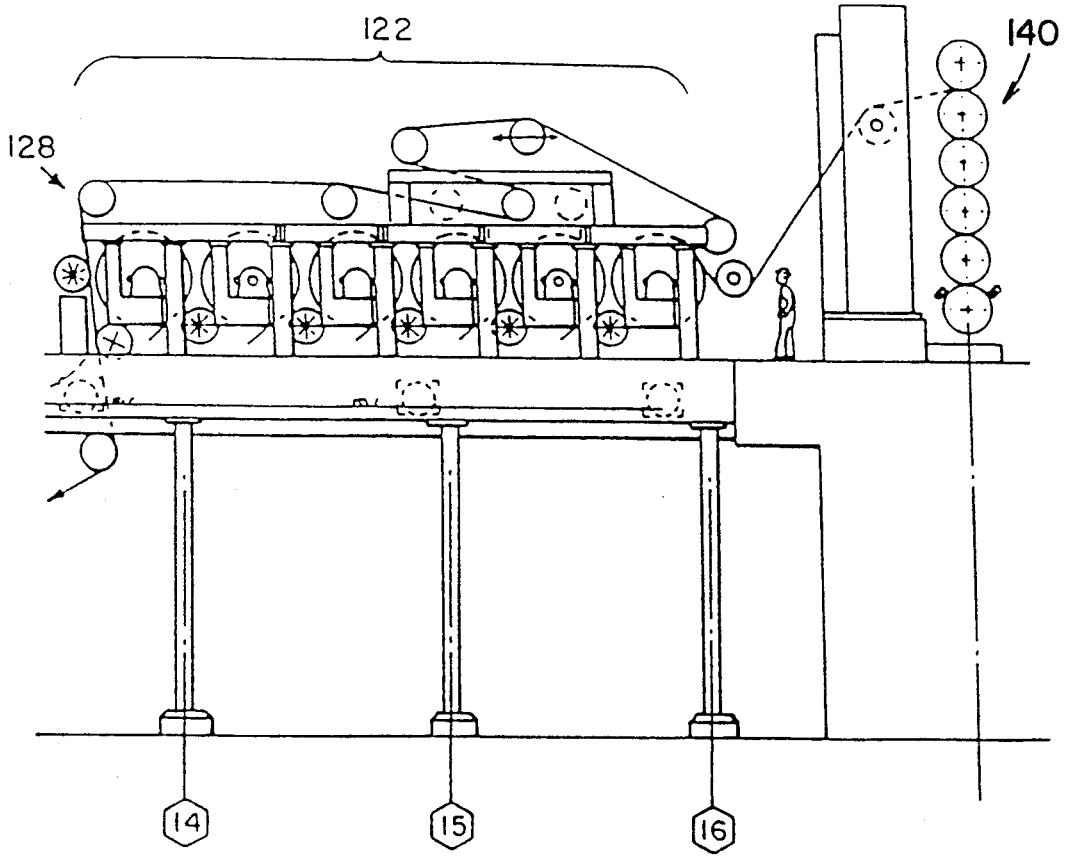
FIG. 7 is an enlarged fragmentary view of FIG. 1 showing the fifth dryer section means.

FIGS. 5, 6, and 7 respectively show third, fourth, and fifth dryer section means respectively and second, third and fourth dryer transfer means 118, 120 and 122 respectively for transferring and reversing the web as the web progresses through the drying apparatus. The first, second, third and fourth dryer transfer means 26, 124, 126 and 128 permit the transfer of the web between the respective dryer sections 16, 22, 118, 120 and 122 without open draw and with an alternate reversing of the web such that the first and second sides of the web are alternately dried as the web extends through the apparatus and past succeeding dryers section means.

Figure 8:
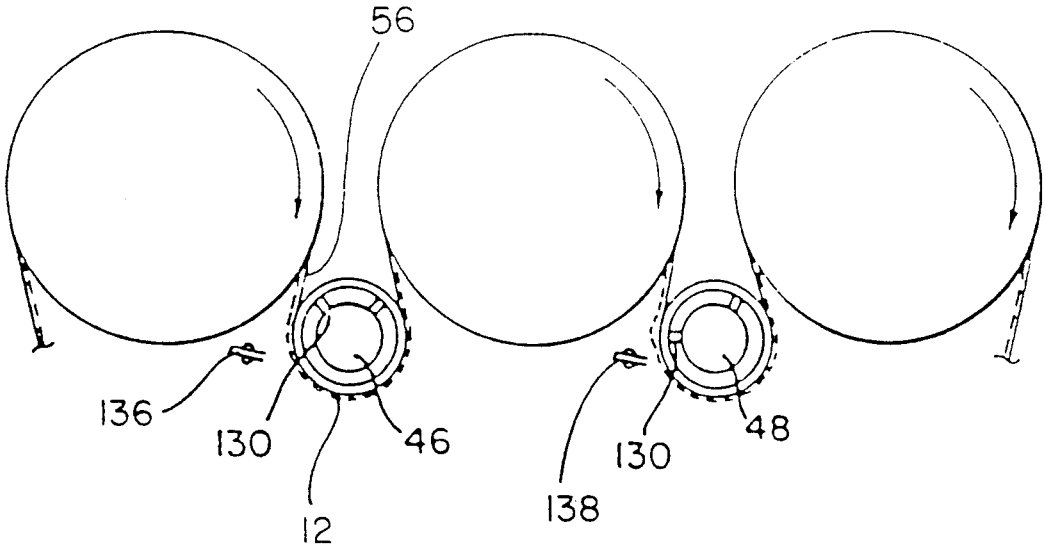
FIG. 8 is a side elevational view of the present invention showing two of the vacuum rolls.

FIG. 8 shows the details of two of the vacuum rolls 46, 48 in which pressure seals 130 may be moved from the position shown with reference to the roll 46 to that shown relative to roll 48 for counteracting the tendency of the web to part from the felt.

In operation of the apparatus the web is transferred from the press section to a first dryer section of the apparatus. Drying of the first side of the web is initiated during passage of the web through the first dryer section 16. The web is transferred without open draw between the first dryer section 16 and a downstream second dryer section 22 with the web transfer being such that the web is reversed so that drying of the second side of the web is initiated during passage of the web through the second dryer section 22.

In operation of the apparatus the web is also transferred without open draw between subsequent dryer sections such that the first and second sides of the web are alternately exposed to the drying effect of the subsequent dryer section in sequence.

The present invention provides a drying section which is capable of operating at extremely high speeds as no open draws exist between the various sections thereof. Furthermore, the present invention enables threading of the drying section without the use of threading ropes.

What is claimed is:

1. A process for drying a paper web, said process comprising the steps of:

arranging first and second pluralities of consecutive cylindrical dryers in a single tier in tandem;

entraining a first run of the web on said first plurality of cylindrical dryers such that one face of said web is exposed to said first plurality of cylindrical dryers;

entraining a second run of the web on said second plurality of cylindrical dryers such that the opposite face of said web is exposed to said second plurality of cylindrical dryers;

rotating said first plurality of cylindrical dryers in one direction and said second plurality of cylindrical dryers in the opposite direction;

overlaying said first run of said web with a first endless belt which moves in concert therewith;

overlaying said second run of said web with a second endless belt which moves in concert therewith;

moving a run of said first endless belt and a run of said second endless belt adjacent and parallel to each other at an interface between said first and second pluralities of cylindrical dryers; and sandwiching said web between said run of said first endless belt and said run of said second endless belt to transfer said web from said first plurality to said second plurality of cylindrical dryers whereby said web is fully supported between said first and second endless throughout the free length between the first and second pluralities of cylindrical dryers.

2. A process as set forth in claim 1, wherein said run of said first and second endless belts are positioned adjacent and parallel to each other by:

entraining said first endless belt at said interface partially around a first vacuum transfer roller journaled for rotation about an axis approximately parallel to the axes of said first plurality of consecutive dryers, said vacuum transfer roller sandwiching said first endless belt and said web between itself and a cylindrical dryer of said first plurality; and entraining said second endless belt at said interface around a second vacuum transfer roller journaled for rotation about an axis approximately parallel to the axes of said second plurality of consecutive dryers, said second vacuum transfer roller sandwiching said second endless belt and said web between itself and a cylindrical dryer of said second plurality.

3. Apparatus for drying a paper web, comprising:

a plurality of cylindrical dryers about which the paper web is transported, said dryers being arranged in tandem in a single tier from the entrance to the exit of said apparatus;

means in continuous contact with said paper web for holding the paper web against the outer surface of said cylindrical dryers throughout the length of said apparatus;

said tier of cylindrical dryers being divided into separate stages;

the continuous contact means comprising separate continuous felt support means at each stage to hold said paper web, said separate felt support means being disposed so that the paper web is supported therebetween throughout its free length between successive stages; and vacuum support means provided between each of said stages to transfer and turn said paper web over so that opposite surfaces of said paper web are directly in contact with the outer surface of said cylindrical dryers in successive stages.

4. The apparatus of claim 3, wherein:

said separate felt support means are arranged so that the paper web is transferred from one stage to the next by being sandwiched between said separate felt support means of one stage and the separate felt support means of the successive stage.

5. Apparatus for drying a paper web, comprising:

a plurality of cylindrical dryers about which the web is transported, said dryers being arranged in tandem in a single tier from the entrance to the exit of said apparatus;

means in continuous contact with said paper web for holding the paper web against the outer surface of said cylindrical dryers throughout the length of said apparatus;

the continuous contact means comprising at least one continuous felt support means for holding said web to the outer surface of said cylindrical dryer;

means for driving said felt support means from one dryer to the next;

vacuum means between adjacent ones of said cylindrical dryers for transferring said felt support means and paper web between successive dryers;

said tier of cylindrical dryers being divided into separate stages;

a separate continuous felt support means for holding said web and driving said rollers being provided for each stage;

vacuum support means are provided between each of said stages to transfer and turn said paper web over so that opposite surfaces of said web are directly in contact with the outer surface of said cylindrical dryers in successive stages; and said separate felt support means for driving adjacent stages being arranged to transfer the paper web from one stage to the next by being sandwiched between said felt support means of one stage and the felt support means of the successive stage between successive vacuum support means so that the web is fully supported between the felt support means of the successive stages throughout the free length between the adjacent stages.

6. A process for drying a paper web, said process comprising the steps of:

arranging first and second pluralities of consecutive cylindrical dryers in a single tier in tandem;

entraining a first run of the web on said first plurality of cylindrical dryers such that one face of said web is exposed to said first plurality of cylindrical dryers;

entraining a second run of the web on said second plurality of cylindrical dryers such that the opposite face of said web is exposed to said second plurality of cylindrical dryers;

rotating said first plurality of cylindrical dryers in one direction and said second plurality of cylindrical dryers in the opposite direction;

overlaying said first run of said web with a first endless belt which moves in concert therewith;

overlaying said second run of said web with a second endless belt which moves in concert therewith;

entraining said first endless belt partially around a vacuum transfer roller journaled for rotation about an axis lying in a plane approximately perpendicular to a plane containing the axes of first and second consecutive cylindrical dryers of said first plurality; and overlaying said first endless belt on said vacuum transfer roll with said web on route from said first cylindrical dryer to said second cylindrical dryer, said vacuum transfer roller being positioned close enough to said first and second cylindrical dryers to sandwich said web and said first endless belt between said vacuum transfer roller and said first and second cylindrical dryers whereby the draw between the vacuum transfer roller and said first and second cylindrical dryers is substantially eliminated.

7. A process for drying a paper web, said process comprising the steps of:

entraining a first run of said web on a first plurality of consecutive cylindrical dryers arranged in tandem to expose one face of said web thereto;

entraining a second rum of said web on a second plurality of consecutive cylindrical dryers arranged in tandem to expose the opposite face of said web thereto;

rotating said first plurality of cylindrical dryers in one direction and said second plurality of cylindrical dryers in the opposite direction;

transferring said web from said first plurality of cylindrical dryers to said second plurality of cylindrical dryers, and reversing said web during said transfer;

overlaying said first run of said web entrained on said first plurality of cylindrical dryers with a first endless belt to bias said web against said first plurality of cylindrical dryers;

overlaying said second run of said web entrained on said second plurality of cylindrical dryers with a second endless belt to bias said web against said second plurality of cylindrical dryers;

entraining said first endless belt partially around a vacuum transfer roller journaled for rotation about an axis lying in a plane approximately perpendicular to a plane containing the axes of first and second consecutive cylindrical dryers of said first plurality; and overlaying said first endless belt on said vacuum transfer roller with said web on route from said first cylindrical dryer to said second cylindrical dryer, said vacuum transfer roller being positioned close enough to said first and second cylindrical dryers to sandwich said web and said first endless belt between said vacuum transfer roller and said first and second cylindrical dryers whereby the draw between the vacuum transfer roller and said first and second cylindrical dryers is substantially eliminated.

8. A process for drying a paper web, said process comprising the steps of:

entraining a first run of said web on a first plurality of consecutive cylindrical dryers arranged in tandem to expose one face of said web thereto;

entraining a second run of said web on a second plurality of consecutive cylindrical dryers arranged in tandem to expose the opposite face of said web thereto;

rotating said first plurality of cylindrical dryers in one direction and said second plurality of cylindrical dryers in the opposite direction;

transferring said web from said first plurality of cylindrical dryers to said second plurality of cylindrical dryers, and reversing said web during said transfer;

overlaying said first run of said web entrained on said first plurality of cylindrical dryers with a first endless belt to move in concert therewith; and overlaying said second run of said web entrained on said second plurality of cylindrical dryers with a second endless belt to move in concert therewith; and wherein the transfer step comprises the steps of:

moving a run of said first endless belt adjacent and parallel to a run of said second endless belt at an interface between said first and second pluralities of cylindrical dryers; and sandwiching said web between said run of said first endless belt and said run of said second endless belt to transfer said web from said first plurality of said second plurality of cylindrical dryers whereby said web is fully supported between said first and second endless belts throughout the free length between the first and second plurality of cylindrical dryers.

* * * * *

UNITED STATES PATENT AND TRADEMARK OFFICE

CERTIFICATE OF CORRECTION

PATENT NO. : 5,175,945

DATED : January 5, 1993

INVENTOR(S) : Borgeir Skaugen; Gregory L. Wedel

It is certified that error appears in the above-indentified patent and that said Letters Patent is hereby corrected as shown below:

| | |
|---|---|
| Column 2, Line 25: | Please insert a new paragraph before "Another". |
| Column 5, LIne 67: | Please insert ---,--- after "section" (first occurrence) |
| Column 9, Line 61: | Please insert ---belts--- before "throughout". |

Signed and Sealed this

Twenty-third Day of November, 1993

*Attest:*

Bruce Lehman

BRUCE LEHMAN

*Attesting Officer*

*Commissioner of Patents and Trademarks*